US006623249B1

(12) United States Patent
Rogers et al.

(10) Patent No.: US 6,623,249 B1
(45) Date of Patent: Sep. 23, 2003

(54) PUMP AND PUMPING METHOD

(76) Inventors: Thomas W. Rogers, 1534 Rosella Ct., Brentwood, TN (US) 37027; William R. Baumann, 16130 W. Armour Ave., New Berlin, WI (US) 53151

( * ) Notice: Subject to any disclaimer, the term of this patent is extended or adjusted under 35 U.S.C. 154(b) by 0 days.

(21) Appl. No.: 10/100,324

(22) Filed: Mar. 18, 2002

(51) Int. Cl.[7] ..... F04B 23/14
(52) U.S. Cl. ..... 417/201; 417/428
(58) Field of Search ..... 417/62, 201, 426, 417/427, 428

(56) References Cited

U.S. PATENT DOCUMENTS 2,206,215 A * 7/1940 Allison et al. ..... 417/62
2,255,560 A * 9/1941 Fieber et al. ..... 417/62
2,492,075 A * 12/1949 Van Atta ..... 417/62
3,010,509 A * 11/1961 Scherenberg ..... 417/201
4,508,490 A 4/1985 Ramirez et al. ..... 417/234
5,032,065 A * 7/1991 Yamamuro et al. ..... 417/428
5,094,597 A * 3/1992 Takai et al. ..... 417/428

* cited by examiner

*Primary Examiner*—Michael Koczo
(74) *Attorney, Agent, or Firm*—Charles M. Kaplan

(57) ABSTRACT

Pumps and methods for inflating objects with atmospheric air employ a fan pump to quickly fill the object with air and then shunt away the air from the fan pump, and use a diaphragm pump to increase the pressure until the inflatable object attains the firmness or pressure required for the object to be useable.

20 Claims, 6 Drawing Sheets

PUMP AND PUMPING METHOD

BACKGROUND OF THE INVENTION

This invention relates to pumps for inflating differently sized objects, and more particularly to motor operated air pumps.

OBJECTIVES OF THE INVENTION

Accordingly, it is an object of this invention to provide improved pumps and pumping methods for inflating objects with atmospheric air.

Another object is to provide a portable inflator pump that can be used to inflate a variety of objects that require different inflation pressures and different volumes of air.

An additional object is to provide an air pump that quickly outputs a relatively large volume of air until an object being inflated is essentially full of air but not hard, and then outputs a relatively small volume of air that raises the pressure until the object is hard enough to use.

Another object is to provide pumps and methods of pumping that can be adjusted to change the pressure, volume of air, and time required to fully inflate various objects.

A further object is to provide pumps and pumping methods that do not require expensive check valves or electronic pressure valves.

Another object is to provide an pump that can be changed from large volume low pressure output to low volume high pressure output merely by turning the dial on a manual valve.

Another object is to provide a air pump in which pump means are connected to the same hose that is always connected to the object being inflated while each pump means is operating.

A further object is to provide a motor operated stage air pump that shunts the flow of low pressure air so as to cool the motor when the high pressure stage is operating.

Another object is to provide non-manual methods of quickly pumping air into inflatable objects and then raising their pressure to a useful value.

Another object is to provide methods of pumping large volumes of air into an object and then raising its pressure through a common outlet for pressurized air.

A further object is to provide a compact air pump that is durable, economical to manufacture and to operate, pleasing in appearance, easy to use and maintain, and which does not possess defects found in similar prior art pumps.

Other objects and advantages of the pumps and pumping methods incorporating this invention will be found in the specification and claims, and the scope of the invention will be set forth in the claims.

DESCRIPTION OF THE INVENTION

Figure 1:
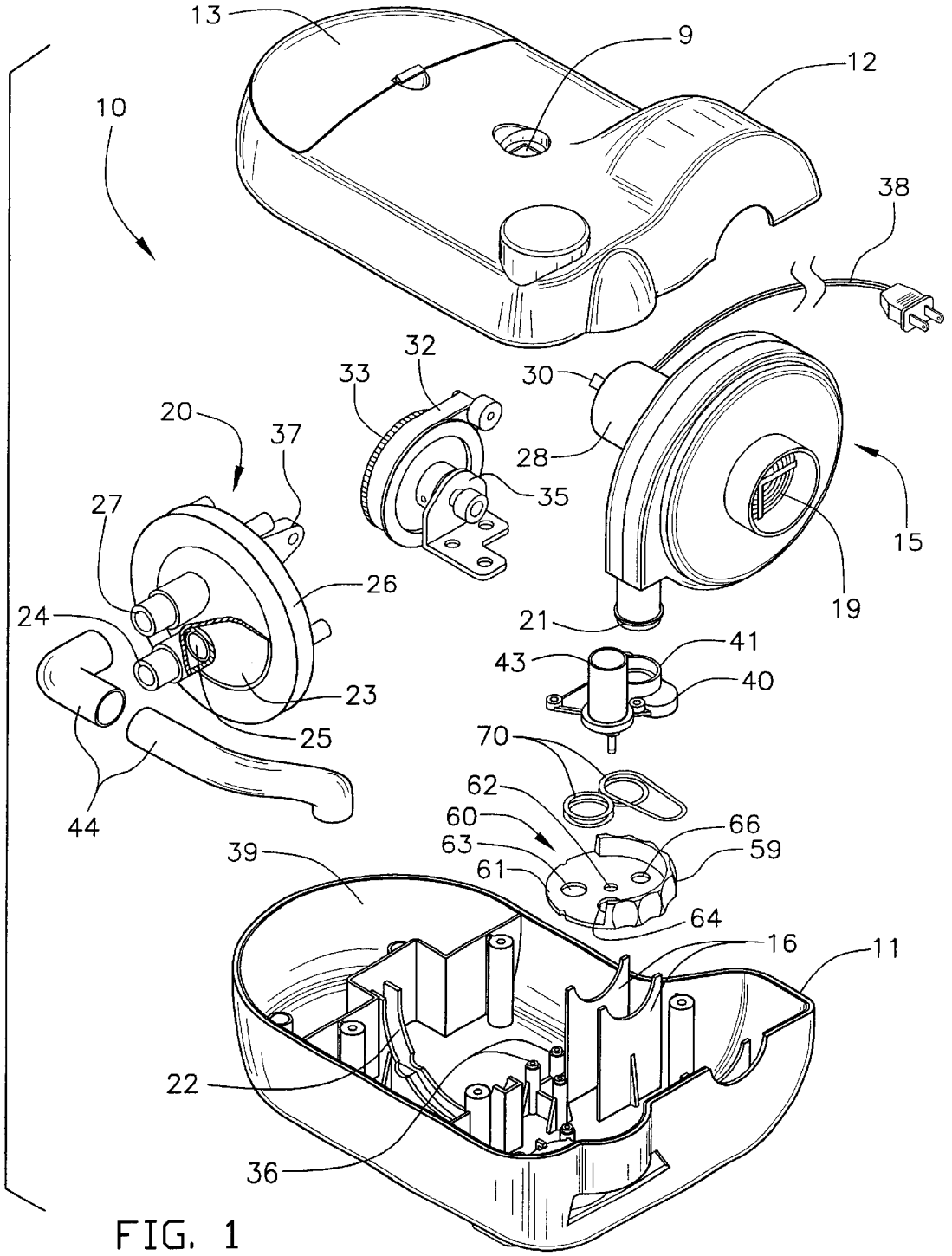
FIG. 1 is an exploded, partially broken away, schematic, perspective view of an embodiment of a pump in accord with this invention.
Figure 2:
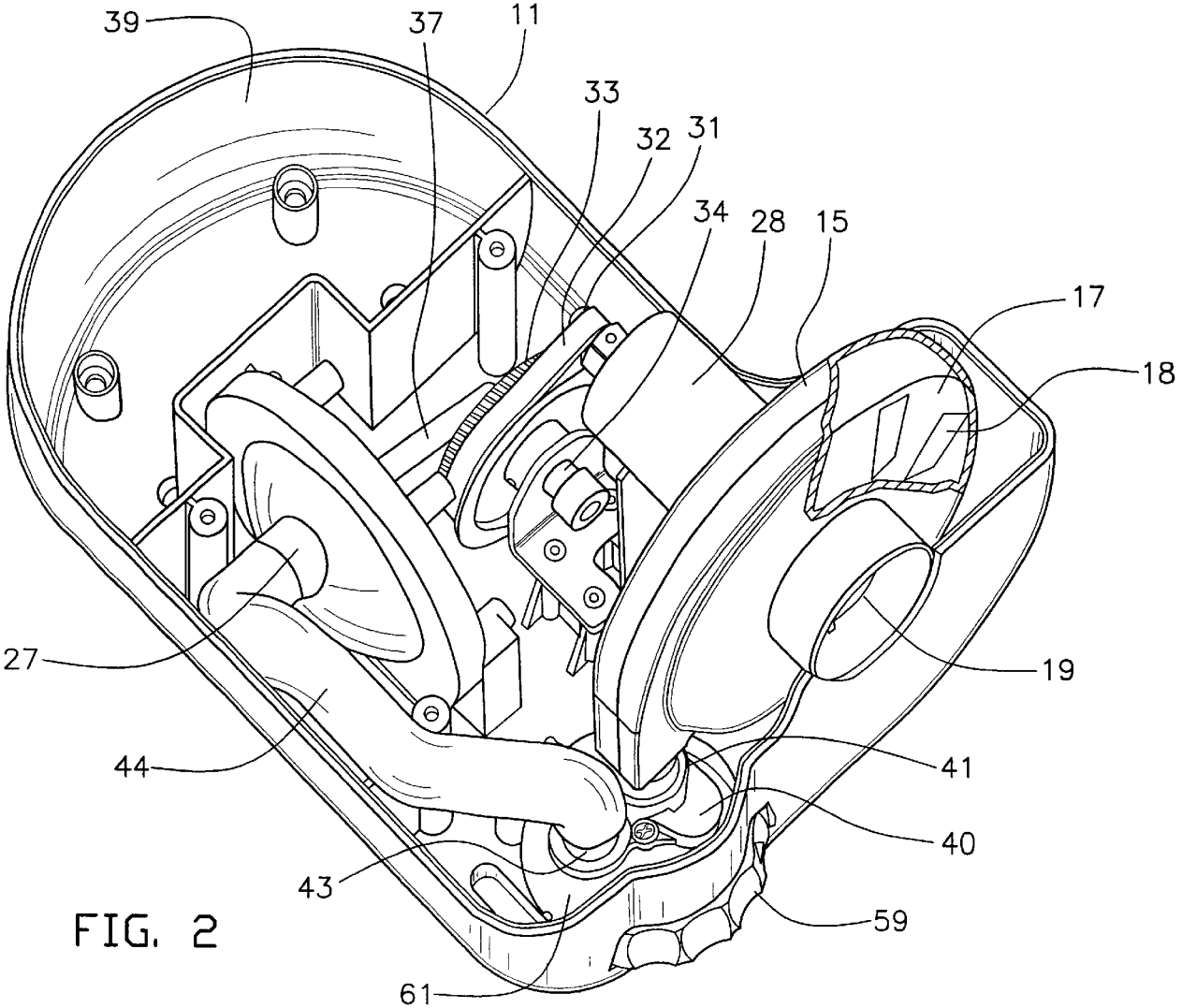
FIG. 2 is a partially broken away, perspective view.

The drawing shows an air inflating pump 10 in accord with this invention in a plastic housing having a bottom portion 11 and a top portion 12 with a removable hatch cover 13. The top and bottom portions 11 and 12 may be separable or permanently attached to each other. Bottom portion 11 has a circular pressurized air discharge outlet 14 that is adapted to be connected to an object being inflated. A plurality of elongated slits 8 in bottom portion 11 vent the housing to the atmosphere, and feet 7 may extend from the bottom.

A relatively high air volume relatively low pressure fan pump 15 of conventional structure is mounted in bottom portion 11 on supports 16. A rotatable circular disk 17 with angled fan blades 18 sucks a high volume ambient air in through an intake opening 19 and pumps the pressurized air out through the open end of a cylindrical discharge duct 21. The pump 15 may output up to about 600 liters per minute of air at pressures up to 1.1 psi.

A relatively low air volume relatively high pressure diaphragm pump 20 of conventional structure is mounted in bottom portion 11 on supports 22. On the intake stroke, a reciprocating diaphragm 23 sucks a low volume of ambient air in through an intake opening 24 past a flap 25 into the pump body 26. On the discharge stroke, the diaphragm 23 pumps the pressurized air out through the open end of a cylindrical discharge duct 27. The pump 20 may output up to about 300 liters per minute of air at pressures in the range of up to 12 psi.

A single electric motor 28 continuously powers both of the pumps 15 and 20 simultaneously. The forward end 29 of the motor shaft is attached directly to the fan disk 17 so that the fan runs at the same number of revolutions as the motor. The rear end 30 of the motor shaft is connected to a small diameter gear 31. A toothed belt 32 couples the gear 31 to a larger gear 33, which is journalled on a shaft 34 that is supported by a bushing 35 on posts 36 in the bottom portion 11. Shaft 34 is coupled to a crank 37 that reciprocates diaphragm 23 in conventional manner. The motor 28 may be permanently or removably connected to an electric plug and cord 38 of any desired length, and the cord may be stored in a hatch 39 that is accessible when the cover 13 is removed. The motor 28 may be a.c. or d. c., and may be turned on and off by an electric switch 9.

Pressurized air from the pumps 15 and 20 passes through an air collection cap 40 before entering outlet opening 14. Cap 40 has an integral, open ended, cylindrical first pipe 41 that receives the discharge duct 21 from pump 15. The duct 21 and pipe 41 define a first pressurized air conduit 42 that connects the fan pump 15 to the discharge outlet 14. The cap has an integral, open ended, cylindrical second pipe 43. The discharge duct 27 of diaphragm pump 20 is connected to pipe 43 by hoses 44. The duct 27, hoses 44 and pipe 43 define a second pressurized air conduit 45 that connects diaphragm pump 20 to the outlet 14. The cap 40 positions the first and second conduits directly above the outlet 14. A low pressure air shunt or escape groove 46 through the bottom of cap 40 has an open end 47 connected to the inside of pipe 41 and a closed end 48 that is positioned above an open or unoccupied zone 49 in bottom portion 11. Zone 49 communicates with the rest of the interior of the pump housing so as to provide a path for air discharged by pump 15. A conventional pressurized air transfer fitting, such as a hollow cone 50, may have one end 51 connected by a friction fit to outlet 14. A reduced diameter end 52 may be inserted into an air inlet valve or button 53 of an inflatable object 54.

Figure 3:
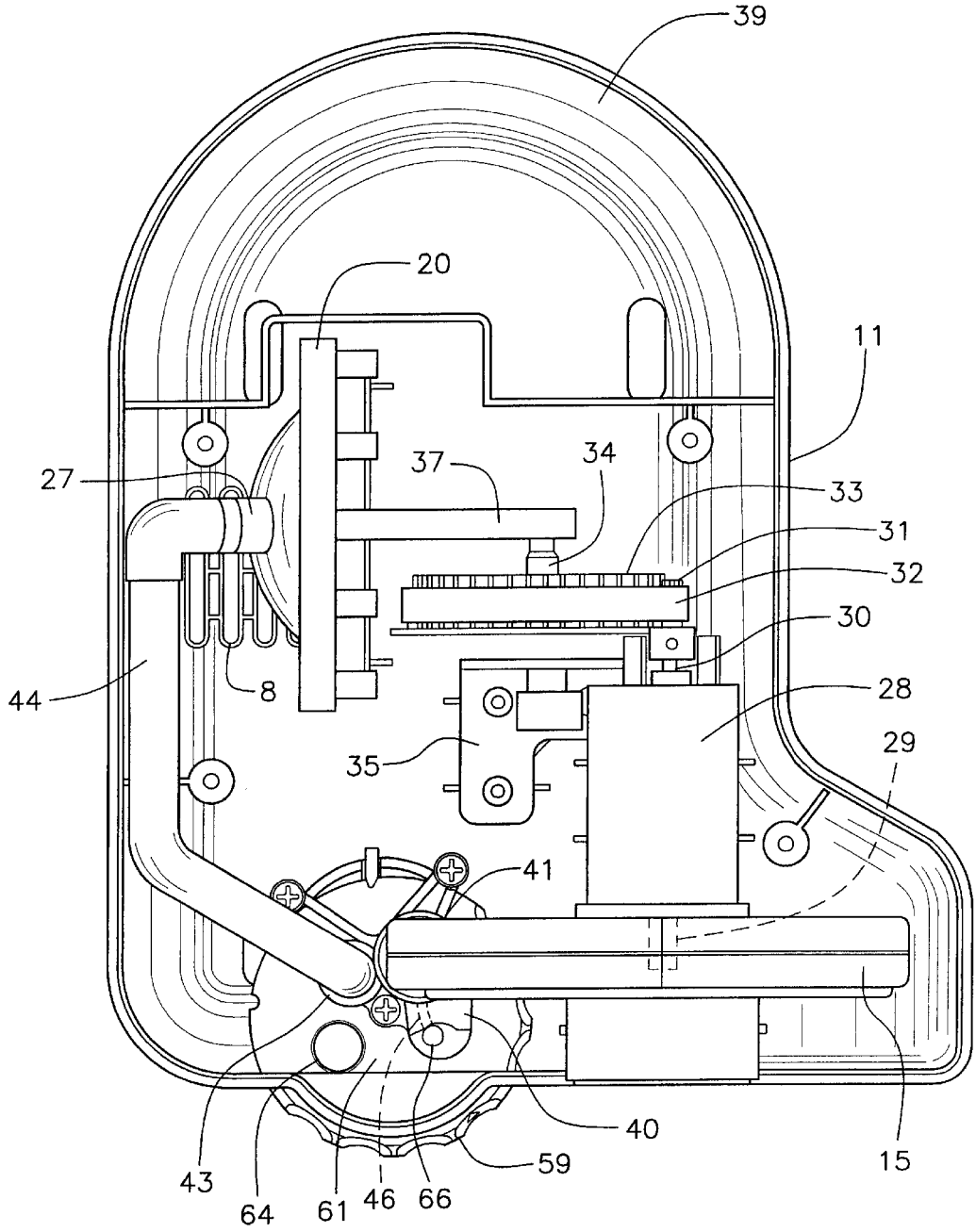
FIG. 3 is an enlarged partially broken away top plan view.
Figure 4:
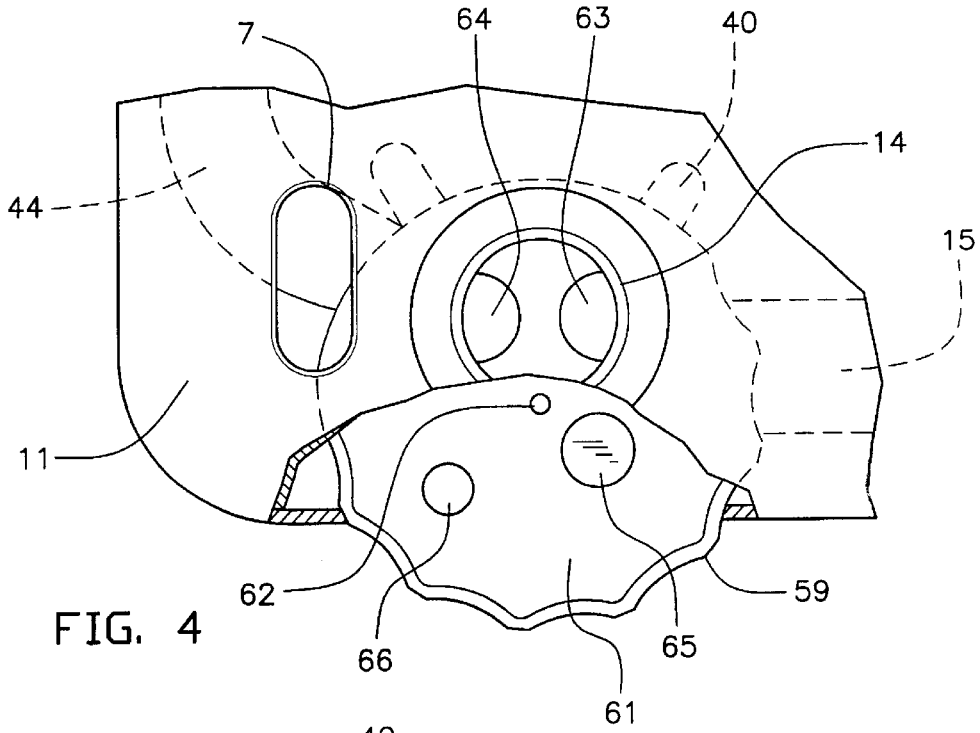
FIG. 4 is a partially broken away, partial bottom plan view showing one position of the valve.
Figure 5:
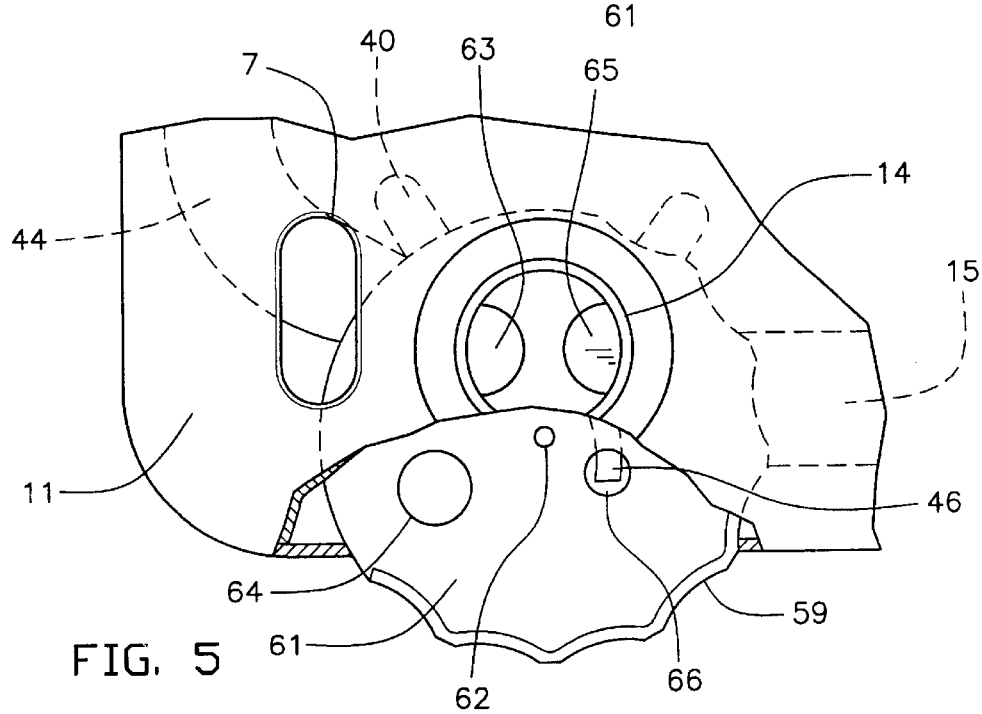
FIG. 5 is a partially broken away, partial bottom plan view showing another position of the valve.
Figure 6:
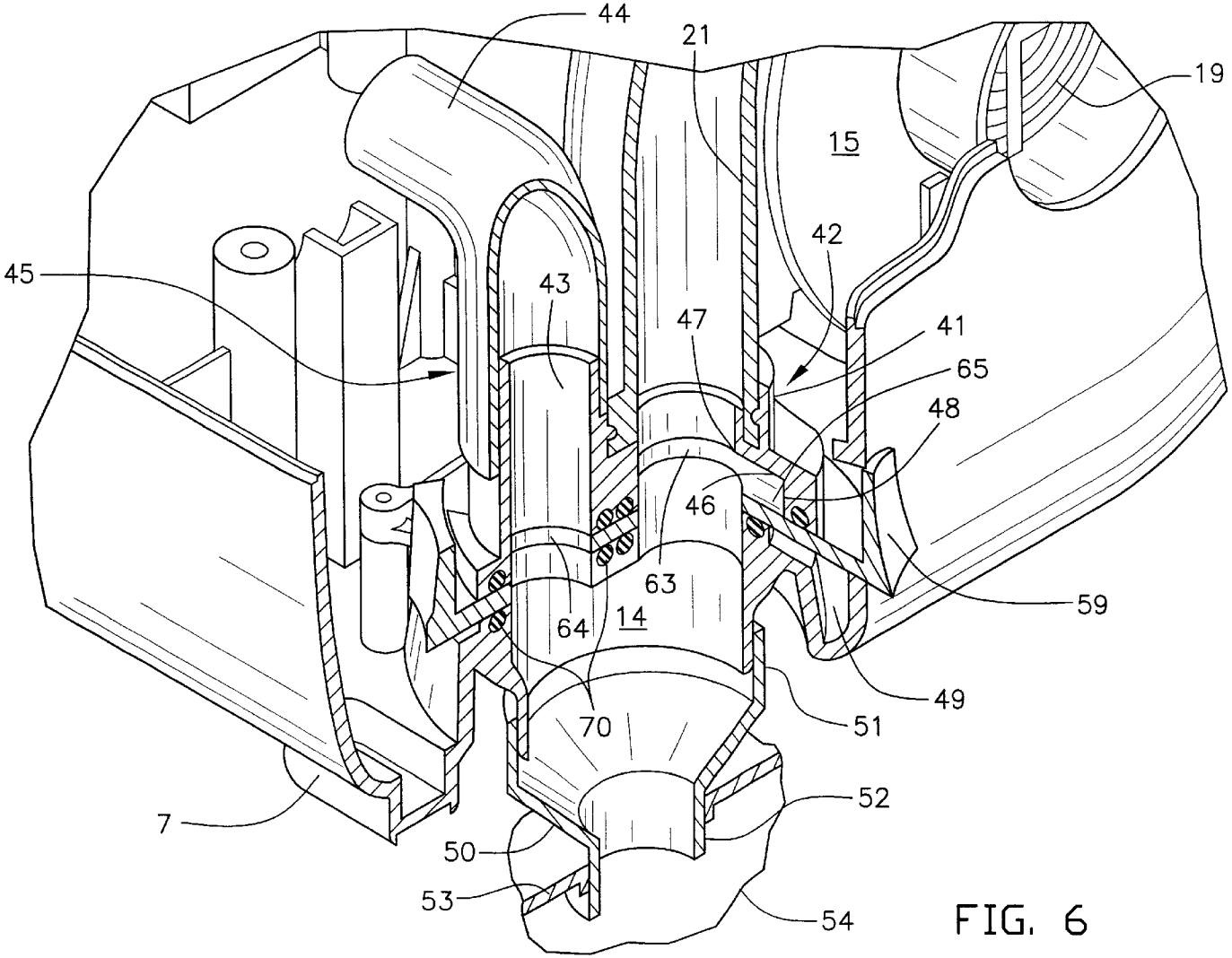
FIG. 6 is an enlarged, partially cross sectional, perspective view showing the valve in the same position as in FIG. 4.
Figure 7:
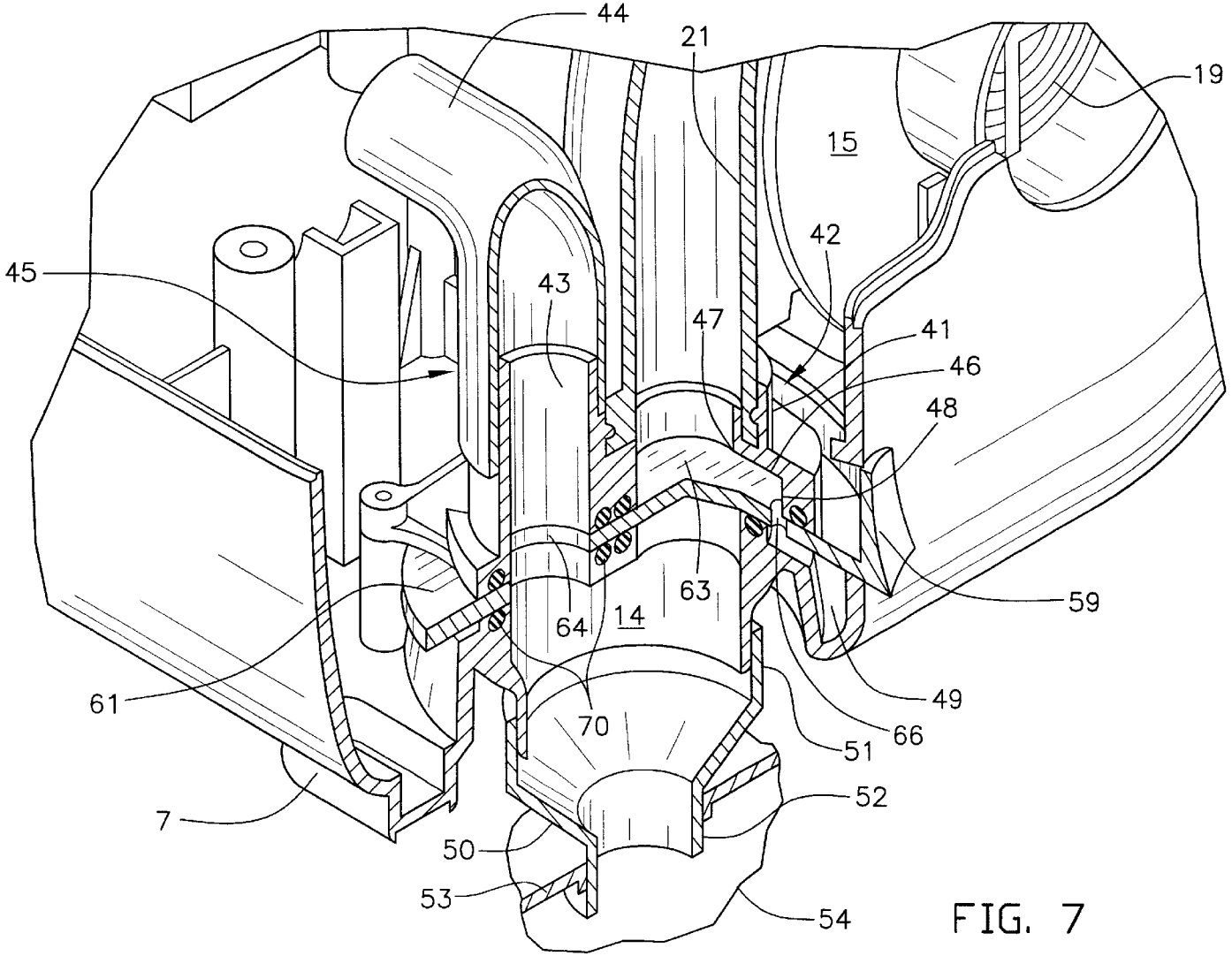
FIG. 7 is an enlarged, partially cross sectional, perspective view showing the valve in the same position as in FIG. 5.

The movement of the dial 59 of a valve 60 controls the flow of pressurized air between the conduits 42 and 45 and the outlet 14. The valve 60 has a first relatively high air volume low pressure position shown in FIGS. 4 and 6, and a second relatively low air volume high pressure position shown in FIGS. 3, 5 and 7. Valve 60 includes a generally circular disk 61 that is integral with dial 59 and is mounted for rotation around its center 62. A plurality of circular, pressurized air flow adjusting passages or holes pass through disk 61.

When the valve 60 is in its first position, a first air flow adjusting hole 63 is aligned with the first conduit 42 above outlet 14, and a second air flow adjusting hole 64, that is identical to hole 63, is aligned with the second conduit 45 above outlet 14. In this position valve 60 enables the pressurized air from both pumps 15 and 20 to flow through outlet 14 into the object 54 that is being inflated. A solid portion 65 of disk 61 is located between groove 46 and zone 49, so that no air can escape through the groove.

The valve 60 is moved to its second position by counterclockwise manual rotation of the dial 59. This moves the first hole 63 out of alignment with the first conduit 42 and into alignment with the second conduit 45. This keeps the second conduit 45 in communication with the outlet 14 so that the relatively higher pressure air from the diaphragm pump 20 is pumped into the object being inflated. The solid portion 65 of the disk 61 has been moved between the first conduit 42 and the outlet 14 so as to block or close off the first conduit and thereby to prevent the low pressure air from the fan pump 15 from being pumped into the object being inflated.

A smaller third air flow adjusting hole 66 through disk 61 is offset from the first and second holes 63 and 64. When the valve is in the first or high air flow position, the third hole 66 is not used because it is not aligned with any air passage, conduit or groove. When the valve has been rotated to the second or high pressure position, the third hole 66 has been moved to a location between the air escape groove 46 and the unoccupied zone 49. This shunts the air flowing from the fan pump 15 through the groove 46 and zone 49 into the interior of the pump housing. The shunted air flowing through the housing helps to cool the motor 28 and the moving parts of other components of the pump. Pressurized air leakage may be prevented by placing gaskets, such as O-rings 70, where required between components located in the pump housing.

It has thus been shown that by the practice of this invention, a variety of inflatable objects, such as air matresses, life rafts, soccer and other types of balls, and inflatable boats, can be quickly and easily filled with ambient air and brought up to an internal pressure where the objects are usable. Simply by manually rotating the dial 59 of valve 60, the degree of alignment between the air flow adjusting holes 63 and 64 and the first and second conduits 42 and 45 can be adjusted to control the volume of air, the pressure and the time required to fill and fully pressurize the object being inflated. By running both pumps 15 and 20 continuously, the need for expensive and complicated circuitry that includes electronic pressure and check valves has been eliminated. The electrical circuitry between the switch and motor, and the fasteners used to hold the various parts in the housing are conventional so they have not been illustrated to simplify the drawings.

While the present invention has been described with reference to a particular embodiment, it is not intended to illustrate or describe all of the equivalent forms or ramifications thereof. Also, the words used are words of description rather than limitation, and various changes may be made without departing from the spirit or scope of the invention disclosed herein. It is intended that the appended claim cover all such changes as fall within the true spirit and scope of the invention.

We claim:

1. An air pump, comprising: a housing having an atmospheric air inlet and an outlet for pressurized air adapted to be connected to an inflatable object; a relatively high air volume low pressure fan pump enclosed in said housing, said fan pump having an atmospheric air intake opening and a pressurized air discharge opening, a first pressurized air conduit connecting the fan pump discharge opening to said outlet for pressurized air; a relatively low volume high pressure diaphragm pump enclosed in said housing, said diaphragm pump having an atmospheric air intake opening and a pressurized air discharge opening; a second pressurized air conduit connecting the diaphragm pump discharge opening to said outlet for pressurized air; and a valve having a high air volume position and a high pressure position, said valve connecting both said first and second conduits to said outlet when it is in its high air volume position and said valve diverting air from said second pressurized air conduit so that only said diaphragm pump discharges pressurized air into said outlet when said valve is in its high pressure position.

2. The air pump defined in claim 1, wherein said valve has holes therethrough that align with said first and second conduits so as to connect said pumps to said outlet for pressurized air.

3. The two stage air pump defined in claim 2, wherein when said valve is in its high air volume position a first hole through said valve aligns with said first conduit so as to connect said fan pump to said outlet and a second hole through said valve aligns with said second conduit so as to connect said diaphragm pump to said outlet, and when said valve is in its high pressure position said valve has moved so that said first hole is aligned with said second conduit so as as to connect said diaphragm pump to said discharge outlet, and a portion of said valve has moved between said first conduit and said discharge outlet so as to block said fan pump from said outlet.

4. The air pump defined in claim 2, wherein when said valve is in its high pressure position, a third hole through said valve vents said fan pump to the inside of said housing.

5. An inflating pump that produces a relatively high volume of air at relatively low pressure and a relatively low volume of air at relatively high pressure, comprising: a housing that is open to the atmosphere, said housing having pressurized air outlet connectable to an object being inflated; a relatively high air volume low pressure rotating fan pump enclosed in said housing, said fan pump having an atmospheric air intake opening and a pressurized air discharge opening in said housing, a first pressurized air conduit connecting the fan pump discharge opening to said outlet for pressurized air; a relatively low volume high pressure reciprocating diaphragm pump enclosed in said housing, said diaphragm pump having an atmospheric air intake opening and a pressurized air discharge opening in said housing; a second pressurized air conduit connecting the diaphragm pump discharge opening to said outlet for pressurized air; said fan pump and said diaphragm pump operating simultaneously; and a valve having a high air volume position and a high pressure position, said valve connecting both said first and second conduits to said outlet when said valve is in its high air volume position and said valve closing said second pressurized air conduit so that only said diaphragm pump discharges pressurized air into said outlet when said valve is in its high pressure position.

6. The inflating pump defined in claim 5, further comprising a single electric motor connected to both said fan pump and said diaphragm pump for rotating said fan pump and reciprocating said diaphragm pump.

7. The inflating pump defined in claim 5, wherein said valve is a rotatable disk having holes therethrough that align with said first and second conduits so as to connect said pumps to said outlet.

8. The inflating pump defined in claim 7, wherein when said valve is in its high air volume position a first hole through said disk aligns with said first conduit so as to connect said fan pump to said outlet and a second hole through said disk aligns with said second conduit so as to connect said diaphragm pump to said outlet, and when said valve is in its high pressure position said disk has rotated so that said first hole is aligned with said second conduit so as to connect said diaphragm pump to said discharge outlet, and a portion of said disk has moved between said second conduit and said outlet so as to seal said fan pump from said outlet.

9. The inflating pump defined in claim 8, wherein when said valve is in its high pressure position, a third hole through said valve vents said fan pump to the inside of said housing.

10. An air inflating pump that produces a relatively high volume of air at relatively low pressure and a relatively low volume of air at relatively high pressure, comprising: a housing that is open to the atmosphere, said housing having pressurized air outlet that is adapted to be connected to an object being inflated; a relatively high air volume relatively low pressure rotating fan pump enclosed in said housing, said fan pump having an atmospheric air intake opening and a pressurized air discharge opening, a first pressurized air conduit connecting the fan pump discharge opening to said outlet for pressurized air; a relatively low volume relatively high pressure reciprocating diaphragm pump enclosed in said housing, said diaphragm pump having an atmospheric air intake opening and a pressurized air discharge opening; a second pressurized air conduit connecting the diaphragm pump discharge opening to said outlet for pressurized air; a single electric motor connected to both said fan pump and said diaphragm pump so as to operate said pumps continuously and simultaneously; and a valve having a high air volume position and a high pressure position, said valve connecting both said first and second conduits to said outlet when said valve is in its high air volume position and said valve closing said second pressurized air conduit so that only said diaphragm pump discharges pressurized air into said outlet when said valve is in its high pressure position.

11. The pump defined in claim 10, wherein said electric motor has a shaft extending from opposite ends thereof, said fan pump comprises a fan blade attached to one end of said shaft, and means for reciprocating said diaphragm pump is attached to the opposite end of said shaft.

12. The two stage pump defined in claim 10, wherein said valve is a rotatable disk having a plurality of holes therethrough that align with said first and second conduits so as to connect said pumps to said outlet.

13. The pump defined in claim 12, wherein when said valve is in its high air volume position a first hole through said disk aligns with said first conduit so as to connect said fan pump to said outlet and a second hole through said disk aligns with said second conduit so as to connect said diaphragm pump to said outlet, and when said valve is in its high pressure position said disk has moved so that said first hole is aligned with said second conduit so as to connect said diaphragm pump to said discharge outlet, and a portion of said disk has moved between said second conduit and said outlet so as to seal said fan pump from said outlet.

14. The pump defined in claim 13, wherein when said valve is in its high pressure position, a third hole through said disk vents said first conduit through an air escape groove to the inside of said housing.

15. A method of inflating and pressurizing an inflatable object with air, comprising the steps of:

rotating a fan pump so as to intake a relatively high volume of air from the atmosphere thereinto, and discharging said relatively high volume of air at a relatively low pressure from said fan pump into a first air conduit;

reciprocating a diaphragm pump so as to intake a relatively low volume of air from the atmosphere thereinto, and discharging said relatively low volume of air at a relatively high pressure from said diaphragm pump into a second conduit;

connecting said first and second conduits to the same pressurized air outlet;

connecting said pressurized air outlet to an inflatable object;

flowing pressurized air from both said first and second conduits through said pressurized air outlet and into said inflatable object until said inflatable object is substantially inflated; and then increasing the pressure in said inflatable object by preventing the flow of relatively low pressure air through said first conduit from entering said pressurized air outlet while continuing the flow of relatively high pressure air through said second conduit into said pressurized air outlet and from there into said inflatable object.

16. The method of inflating and pressurizing an inflatable object defined in claim 15, wherein said flow of low pressure air in said first conduit and said flow of high pressure air in said second conduit are introduced into said pressurized air outlet by aligning a first hole through a valve with said first conduit, and aligning a second hole through said valve with said second conduit.

17. The method of inflating and pressurizing an inflatable object defined in claim 16, wherein said flow of low pressure air in said first conduit is prevented from entering said pressurized air outlet by rotating said valve so as to move said second hole out of alignment with said first conduit.

18. The method of inflating and pressurizing an inflatable object defined in claim 16, wherein said flow of relatively high pressure air is continued from said second conduit into said pressurized air outlet by rotating said valve so that second hole is moved out of alignment with said second conduit but said first hole is moved into alignment with said second conduit.

19. The method of inflating and pressurizing an inflatable object defined in claim 15, wherein said flow of low pressure air is prevented from entering said pressurized air outlet by rotating a valve to a position that blocks air flow from said first conduit into said pressurized air outlet.

20. The method of inflating and pressurizing an inflatable object defined in claim 19, further comprising enclosing all components in a housing, and shunting into said housing said flow of low pressure air that is prevented from entering said pressurized air outlet so as to cool moving components located in said housing.

* * * * *